US012685380B2

(12) United States Patent
Chen

(10) Patent No.: US 12,685,380 B2
(45) Date of Patent: Jul. 21, 2026

(54) COSMETIC CONTAINER

(71) Applicant: GLASPRAY ENGINEERING & MANUFACTURING CO., LTD., Tainan City (TW)

(72) Inventor: Chia-Te Chen, Tainan City (TW)

(73) Assignee: GLASPRAY ENGINEERING & MANUFACTURING CO., LTD., Tainan City (TW)

( * ) Notice: Subject to any disclaimer, the term of this patent is extended or adjusted under 35 U.S.C. 154(b) by 0 days.

(21) Appl. No.: 19/008,085

(22) Filed: Jan. 2, 2025

(65) Prior Publication Data

US 2026/0182724 A1 Jul. 2, 2026

(51) Int. Cl.

| | |
|---|---|
| ***A45D 33/00*** | (2006.01) |
| ***A45D 40/00*** | (2006.01) |
| ***B65D 53/04*** | (2006.01) |
| ***B65D 77/04*** | (2006.01) |

(52) U.S. Cl.

CPC ..... *A45D 40/00* (2013.01); *B65D 53/04* (2013.01); *B65D 77/0486* (2013.01); *A45D 2200/05* (2013.01)

(58) Field of Classification Search

CPC .... B65D 77/0486; B65D 53/02; B65D 43/16; B65D 77/04; B65D 53/04; A45D 33/006; A45D 33/24; A45D 40/22; A45D 2200/51; A45D 40/0068; A45D 34/00; A45D 40/00; A45D 2200/05

USPC ..... 132/300, 294, 314, 317; 206/581, 823, 206/385, 229, 216

See application file for complete search history.

(56) References Cited

U.S. PATENT DOCUMENTS

| | | | | |
|---|---|---|---|---|
| 7,381,003 | B1 * | 6/2008 | Chang | A45D 40/0075 401/16 |
| 2004/0089318 | A1 * | 5/2004 | Tahara | A46B 11/0006 132/317 |

* cited by examiner

*Primary Examiner* — King M Chu

(74) *Attorney, Agent, or Firm* — MUNCY, GEISSLER, OLDS & LOWE, P.C.

(57) ABSTRACT

A cosmetic container has an outer receptacle, a refill receptacle detachably disposed in the outer receptacle, a seal closing the refill receptacle, and an outer cap closing the outer receptacle. The outer receptacle has a rim formed around an upper opening thereof and multiple engaging blocks formed on an internal peripheral surface of the rim. The refill receptacle has multiple holding portions and has multiple engaging recesses formed in an external peripheral surface of the refill receptacle and configured to engage with the engaging blocks. The holding portions are mounted to the rim of the outer receptacle and partially cover an external peripheral surface of the rim. With the engagements of the engaging blocks inside the outer receptacle and the engaging recesses of the refill receptacle, the refill receptacle is replaceable, reducing resource waste. Appearance of the cosmetic container is improved as residues of dirt and grease are avoided.

12 Claims, 9 Drawing Sheets

COSMETIC CONTAINER

BACKGROUND OF THE INVENTION

1. Field of the Invention

The present invention relates to a cosmetic container, and more particularly to a cosmetic container for containing cosmetic products.

2. Description of the Prior Art

In order to improve skin condition or skin health, people apply cosmetics on their skin in daily life. Active ingredients in the cosmetics may be absorbed by the skin to moisturize the skin or enhance skin health. Cosmetics on the market are mostly contained in cosmetic containers of high quality or with alluring appearances to attract customers to purchase or collect them.

A conventional cosmetic container comprises a container body and a cap. The container body is configured to contain cosmetics. The cap closes the container body. A consumer may get the cosmetics within the container body by opening the cap. However, the conventional cosmetic container cannot be reused after the cosmetics within the container body is used up, so the consumer may throw away the empty cosmetic container and buy a new one. Therefore, a waste of resources is brought about.

A conventional cosmetic container as shown in FIGS. 8 and 9 is provided on the market. The conventional cosmetic container comprises an outer receptacle set 80 and a refill set 90. The outer receptacle set 80 includes an outer receptacle body 81 and a cap 82. The outer receptacle body 81 has a chamber 811 with an upper opening, a threaded portion 812 formed around the upper opening and configured to connect with the cap 82 via a thread engagement, and two engaging recesses 813 respectively formed at diametrically opposite sides of the threaded portion 812. The refill set 90 is detachably disposed in the containing chamber 811 of the outer receptacle body 81 and comprises a refill receptacle 91 and a seal membrane 92 covering the refill receptacle 91. The refill receptacle 91 is configured to contain cosmetics and has two engaging portions 911 extending downwardly at diametrically opposite sides of a rim of the refill receptacle 91. The refill set 90 engages the outer receptacle body 81 by placing the two engaging portions 911 respectively into the two engaging recesses 813 and turning the refill set 90 to engage with the two engaging recesses 813 of the outer receptacle body 81.

When the cosmetics within the refill receptacle 91 are used up, the consumer may keep the outer receptacle set 80 and replace the refill set 90 with a new one to refill the cosmetics for reducing resource waste. However, the engaging recesses 813 formed in an external surface of the threaded portion of the outer receptacle body 81 diminish the visual appeal of the external container body 81. When the cosmetics are used up and the refill receptacle 91 is removed from the outer receptacle body 81, the cosmetics or dirt and grease on the hand may attach to the engaging recesses 813. After long-term use, residues of the cosmetics stuck in the engaging recesses 813 are prone to deterioration or breed bacteria.

To overcome the shortcomings, the present invention provides a cosmetic container to mitigate or obviate the aforementioned problems.

SUMMARY OF THE INVENTION

The main objective of the present invention is to provide a cosmetic container to improve the situation that residues of cosmetics and dirt and grease are prone to be stuck on the outer receptacle body of a conventional cosmetic container and lead to hygienic problems.

The cosmetic container comprises an outer receptacle, a refill receptacle, a seal, and an outer cap. The outer receptacle comprises a mounting chamber in the outer receptacle and having an upper opening, a threaded portion formed around the upper opening of the mounting chamber, a rim extending upwardly from the threaded portion, and multiple engaging blocks protruding from an internal peripheral surface of the rim and spaced apart from one another. The refill receptacle is detachably disposed in the mounting chamber of the outer receptacle and comprises a containing chamber in the refill receptacle and having an upper opening in the refill receptacle, multiple holding portions arranged around the upper opening of the containing chamber, mounted to the rim of the outer receptacle, and partially covering an external peripheral surface of the rim, and multiple engaging recesses formed in an external peripheral surface of the refill receptacle, spaced apart from one another, and configured to respectively receive and engage with the multiple engaging blocks of the outer receptacle. The seal is detachably disposed on the refill receptacle and configured to close the containing chamber. The outer cap is detachably disposed at the outer receptacle, is connected to the threaded portion of the outer receptacle via a thread engagement, and is configured to close the mounting chamber.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
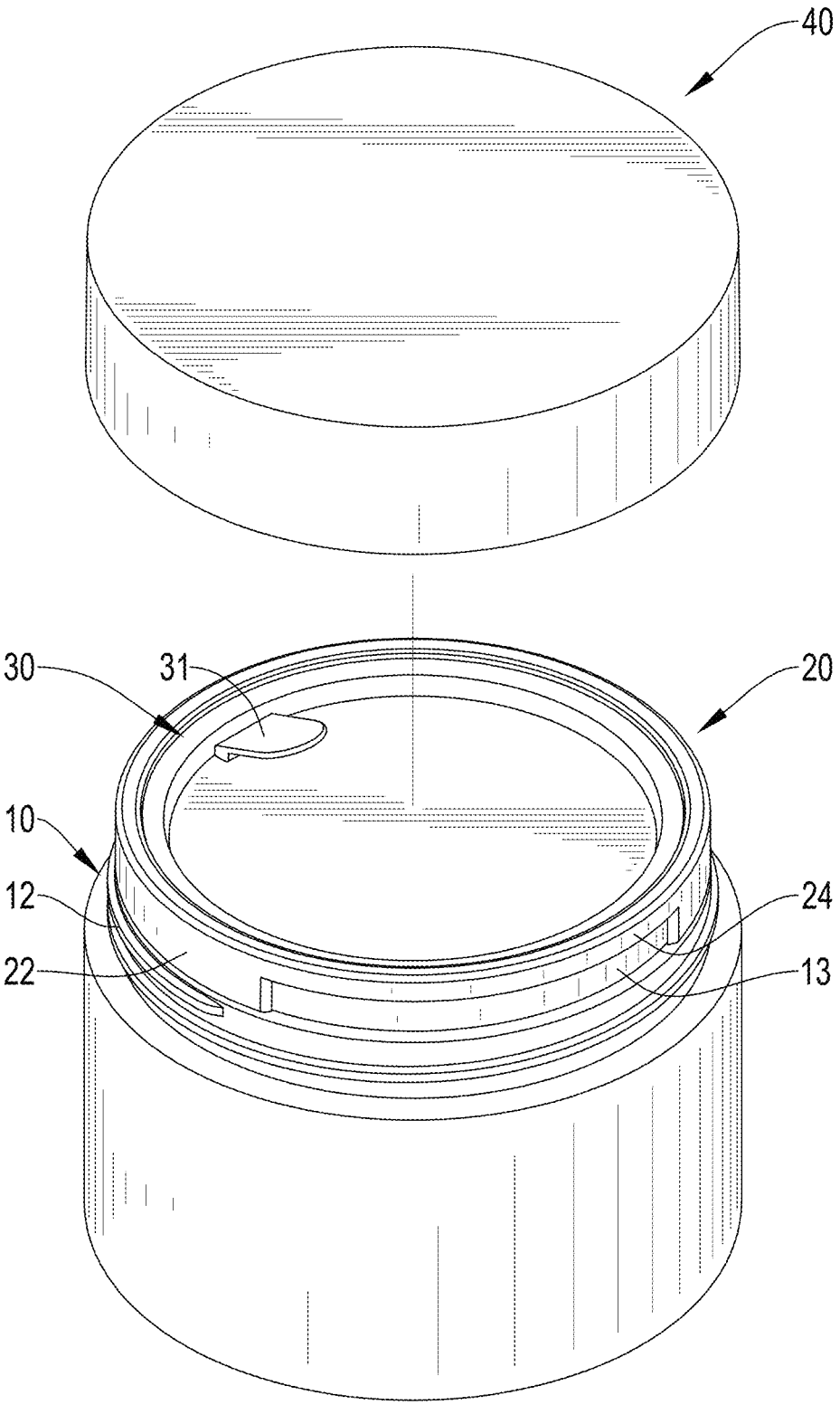
FIG. 1 is an exploded perspective view of a cosmetic container in accordance with the present invention, showing that an outer cap is separated from an outer receptacle.
Figure 2:
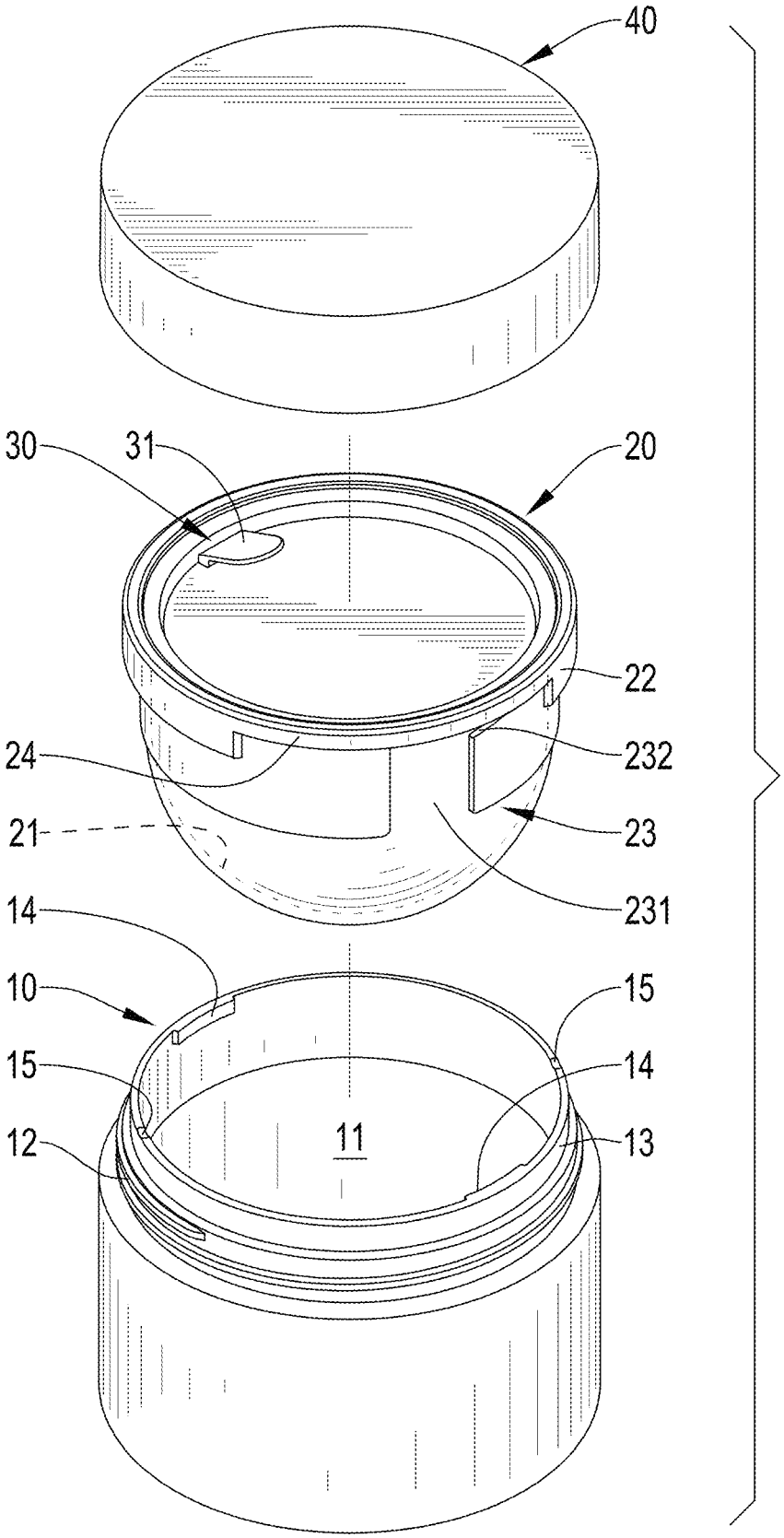
FIG. 2 is an exploded perspective view of the cosmetic container in FIG. 1.

With reference to FIGS. 1 and 2, a cosmetic container in accordance with the present invention comprises an outer receptacle 10, a refill receptacle 20, a seal 30, and an outer cap 40.

With reference to FIG. 2, the outer receptacle 10 has a mounting chamber 11 in the outer receptacle 10 and having an upper opening, a threaded portion 12 formed around the upper opening of the mounting chamber 11, a rim 13 extending upwardly from the threaded portion 12, and multiple engaging blocks 14 protruding from an internal peripheral surface of the rim 13 and spaced apart from one another.

Figure 3:
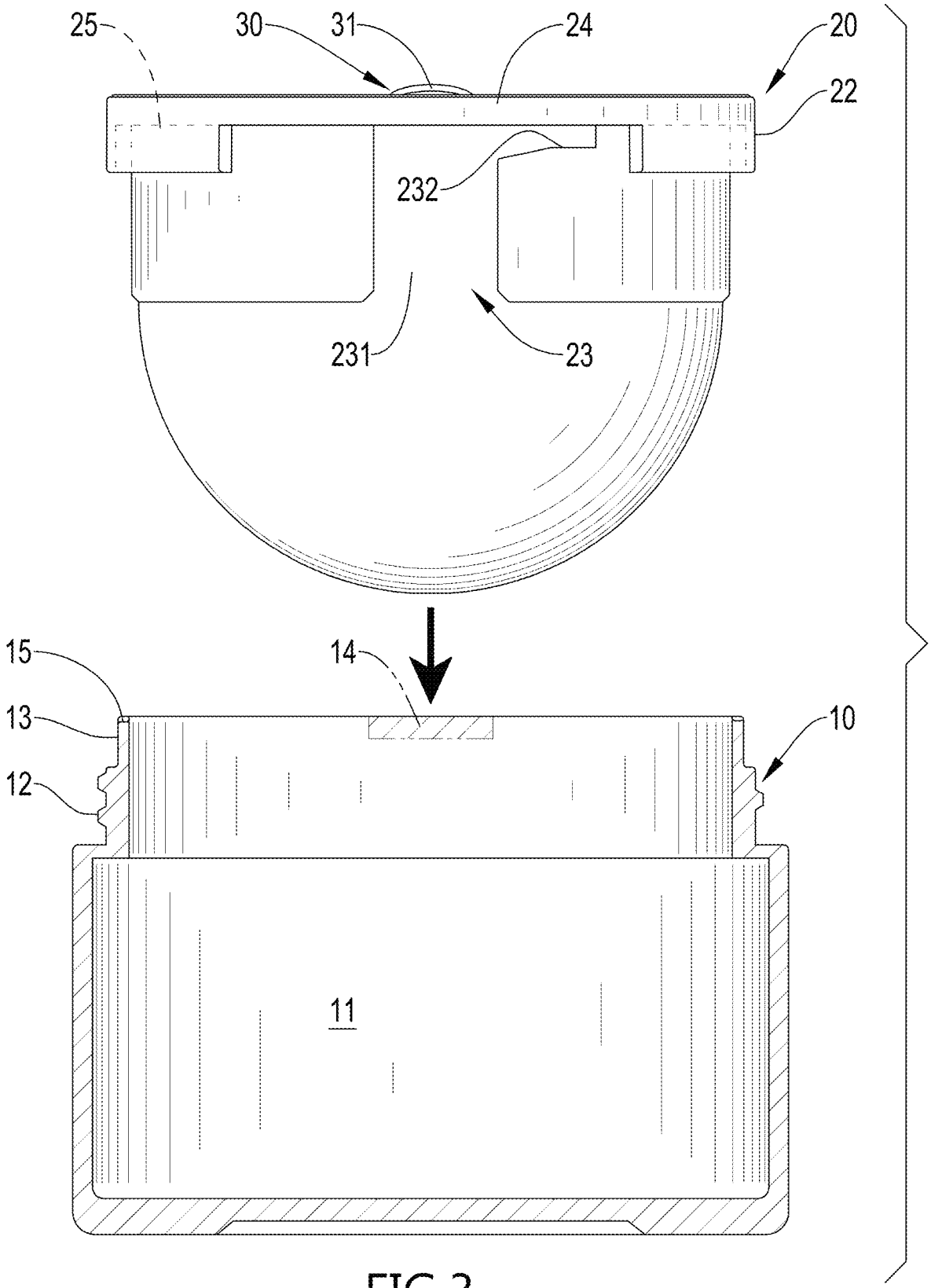
FIG. 3 is an exploded side view in partial section of the cosmetic container in FIG. 1.
Figure 6:
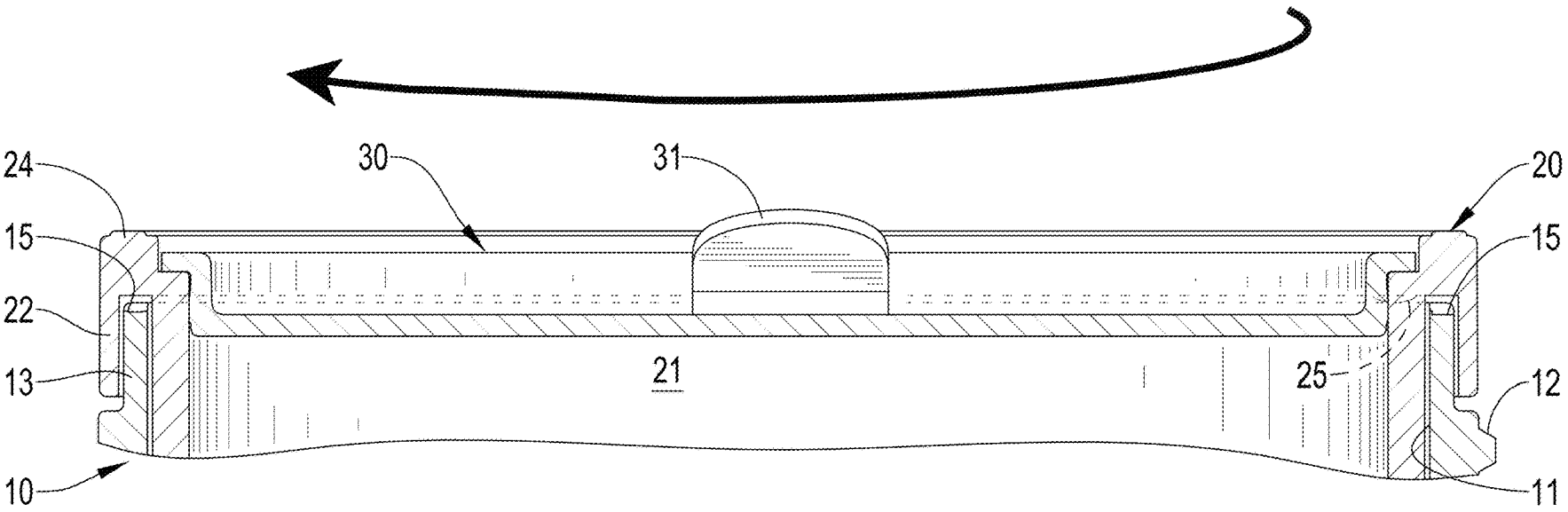
FIG. 6 is an operational enlarged side view in partial section of the cosmetic container in FIG. 1 and shows that the refill receptacle is rotated relative to the outer receptacle.

With reference to FIGS. 2, 3, and 6, the refill receptacle 20 has a containing chamber 21 in the refill receptacle 20 and having an upper opening, multiple holding portions 22 arranged around the upper opening of the containing chamber 21 at an outer side thereof, and multiple engaging recesses 23 formed in an external peripheral surface of the refill receptacle 20 and spaced apart from one another. The refill receptacle 20 is detachably disposed in the mounting chamber 11 of the outer receptacle 10. The engaging blocks 14 of the outer receptacle 10 are respectively received by and engaged with the multiple engaging recesses 23. The multiple holding portions 22 are mounted to the rim 13 of the outer receptacle 10 and partially cover an external peripheral surface the rim 13. The multiple holding portions 22 are spaced apart from the external peripheral surface of the refill receptacle 20 for receiving the rim 13 of the outer receptacle 10 therebetween. The multiple engaging recesses 23 are arranged between the multiple holding portions 22. Each of the multiple engaging recesses 23 is located between adjacent two of the multiple holding portions 22.

With reference to FIG. 3, each engaging recess 23 of the refill receptacle 20 has a guiding section 231 and a locking section 232 formed at a side of the guiding section 231. Each engaging block 14 of the outer receptacle 10 is configured to be moved into and engage with the locking section 232 via the guiding section 231 of a respective one of the engaging recesses 23. Specifically, the locking section 232 peripherally extends along the external peripheral surface of the refill receptacle 20. The guiding section 231 extends downwardly from an end of the locking section 232.

With reference to FIGS. 2, 3, and 6, the refill receptacle 20 comprises a blocking flange 24 extending outwardly from the upper opening of the containing chamber 21 thereof. The blocking flange 24 abuts a top of the rim 13 of the outer receptacle 10. The multiple engaging recesses 23 extend downwardly from a bottom of the blocking flange 24. The refill receptacle 20 comprises multiple positioning parts 25 formed at the bottom of the blocking flange 24. The outer receptacle 10 comprises multiple blocking parts 15 at a top of the rim 13 and configured to engage with the multiple positioning parts 25 of the refill receptacle 20. Specifically, each positioning part 25 may be a protrusion and each blocking part 15 may be a notch for receiving the positioning part 25 being protruded.

With reference to FIGS. 1, 2, and 6, the seal 30 is detachably disposed on the refill receptacle 20 and is configured to close the containing chamber 21. The seal 30 has a tab 31 on a top thereof to provide a holding part for a consumer to conveniently remove the seal 30.

With reference to FIGS. 1 and 2, the outer cap 40 is detachably disposed at the outer receptacle 10, is connected to the threaded portion 12 of the outer receptacle 10 via a threaded engagement, and is configured to close the mounting chamber 11.

With reference to FIGS. 1 and 2, the refill receptacle 20, detachably disposed in the outer receptacle 10, is configured to be filled with cosmetics in the containing chamber 21. After the cosmetics within the refill receptacle 20 are used up, the refill receptacle 20 in the outer receptacle 10 is replaced with a new one so that the outer receptacle 10 is reusable. Thereby, a waste of resources is reduced.

Figure 4:
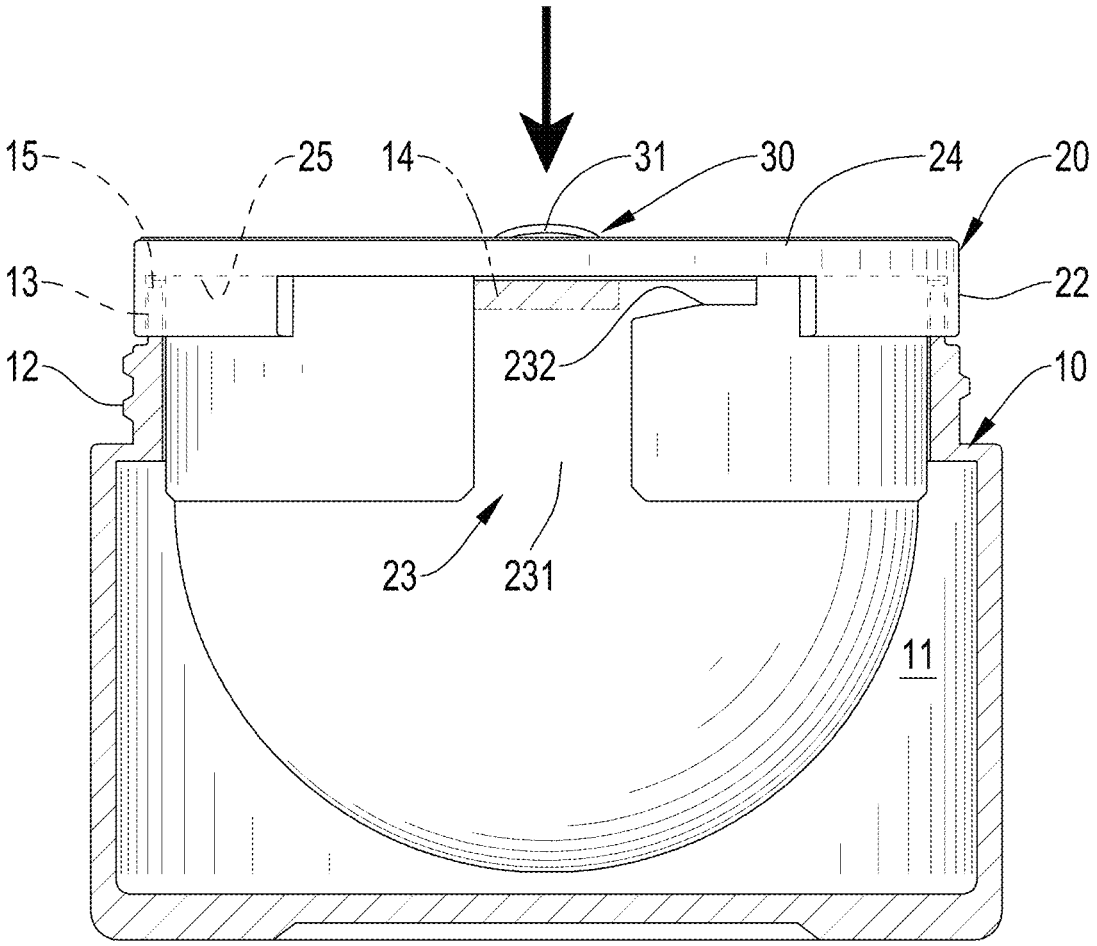
FIG. 4 is a side view in partial section of the cosmetic container in FIG. 1 and shows that engaging blocks of the outer receptacle are received by the guiding sections of the engaging recesses of a refill receptacle.
Figure 5:
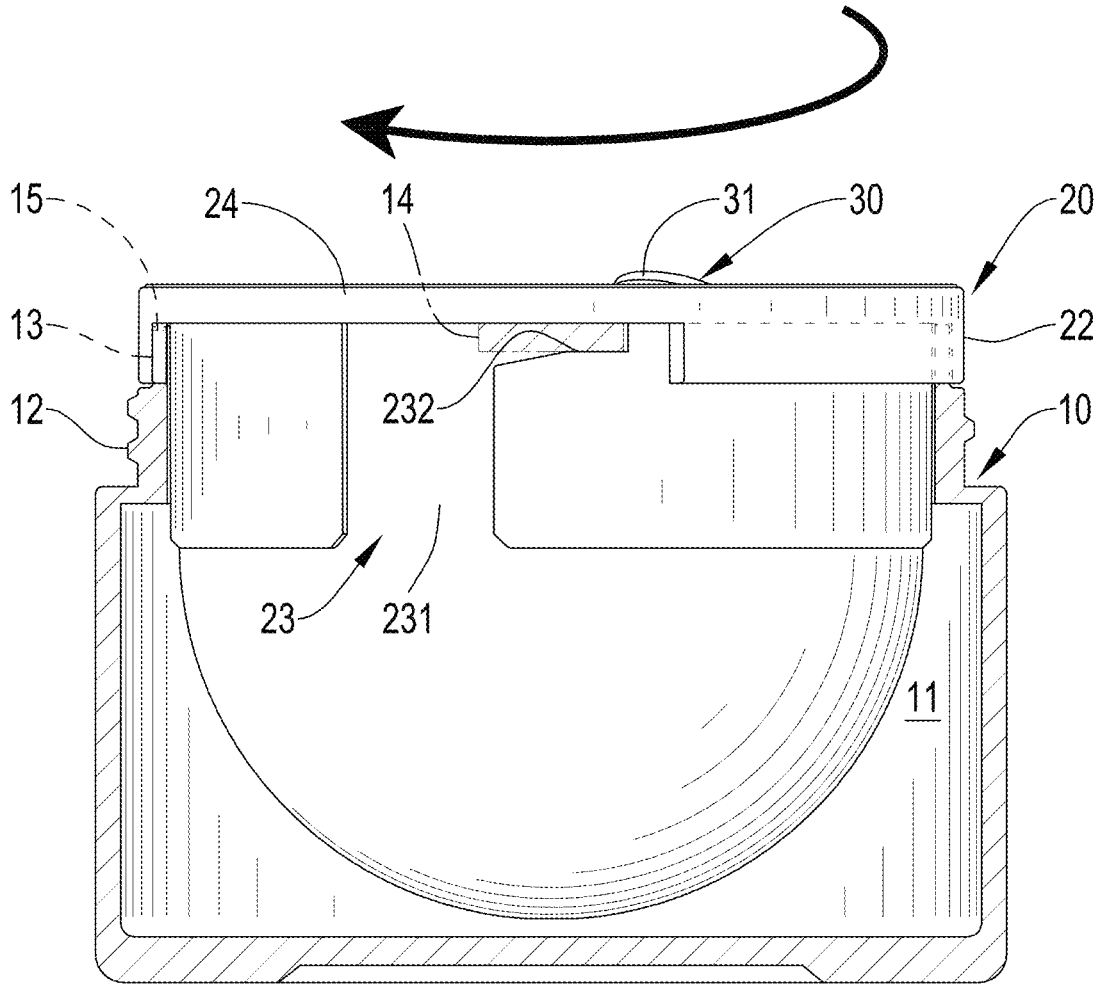
FIG. 5 is a side view in partial section of the cosmetic container in FIG. 1 and shows that the engaging blocks of the outer receptacle are moved into and engage with the locking sections of the engaging recesses of the refill receptacle.

With reference to FIGS. 3 to 5, to assemble the refill receptacle 20, the consumer may place the refill receptacle 20 into the mounting chamber 11 of the outer receptacle 10 with the multiple engaging blocks 14 of the outer receptacle 10 respectively placed in the guiding sections 231 of the multiple engaging recesses 23 of the refill receptacle 20. After that, the consumer May grip the holding portions 22 of the refill receptacle 20 to rotate the refill receptacle 20 relative to the outer receptacle 10, to move the multiple engaging blocks 14 from the guiding sections 231 to respectively engage with the locking sections 232. In this way, assembly of the refill receptacle 20 and the outer receptacle 10 is completed.

Figure 7:
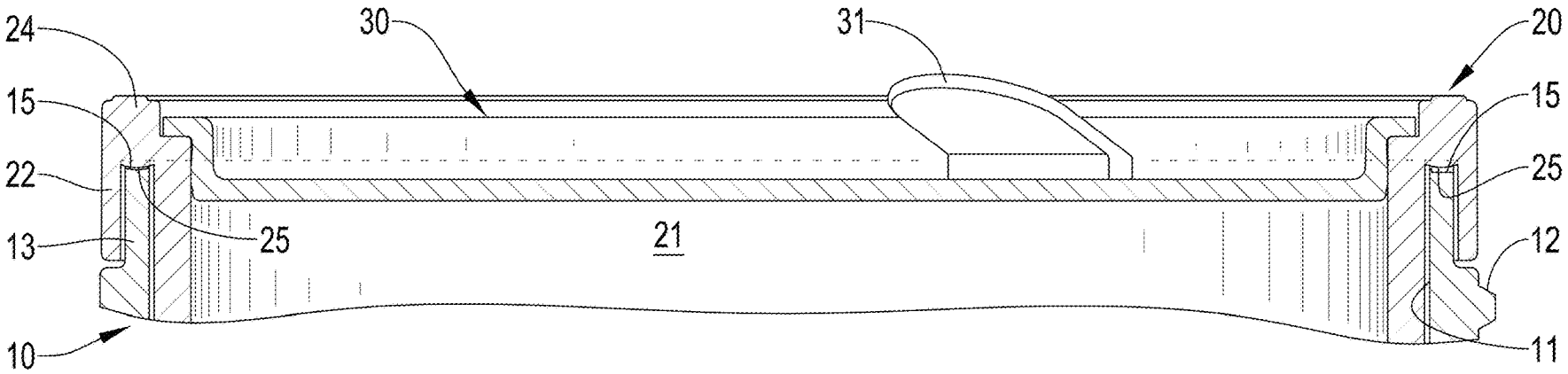
FIG. 7 is an enlarged cross-sectional side view of the cosmetic container in FIG. 1 and shows that the positioning parts of the refill receptacle engage with the blocking parts of the outer receptacle.
Figure 8:
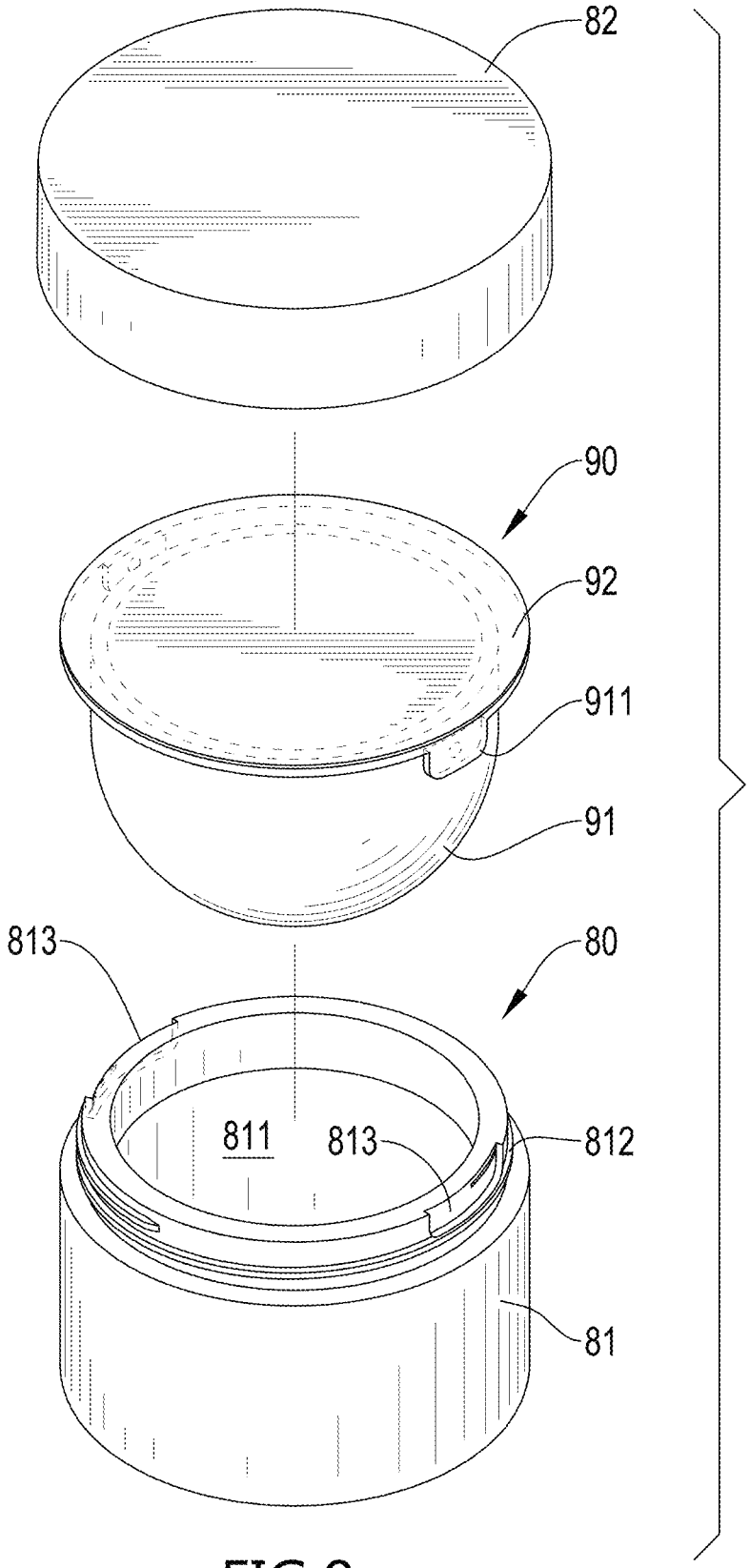
FIG.8 PRIOR ART
FIG. 8 is an exploded perspective view of a conventional cosmetic container.
Figure 9:
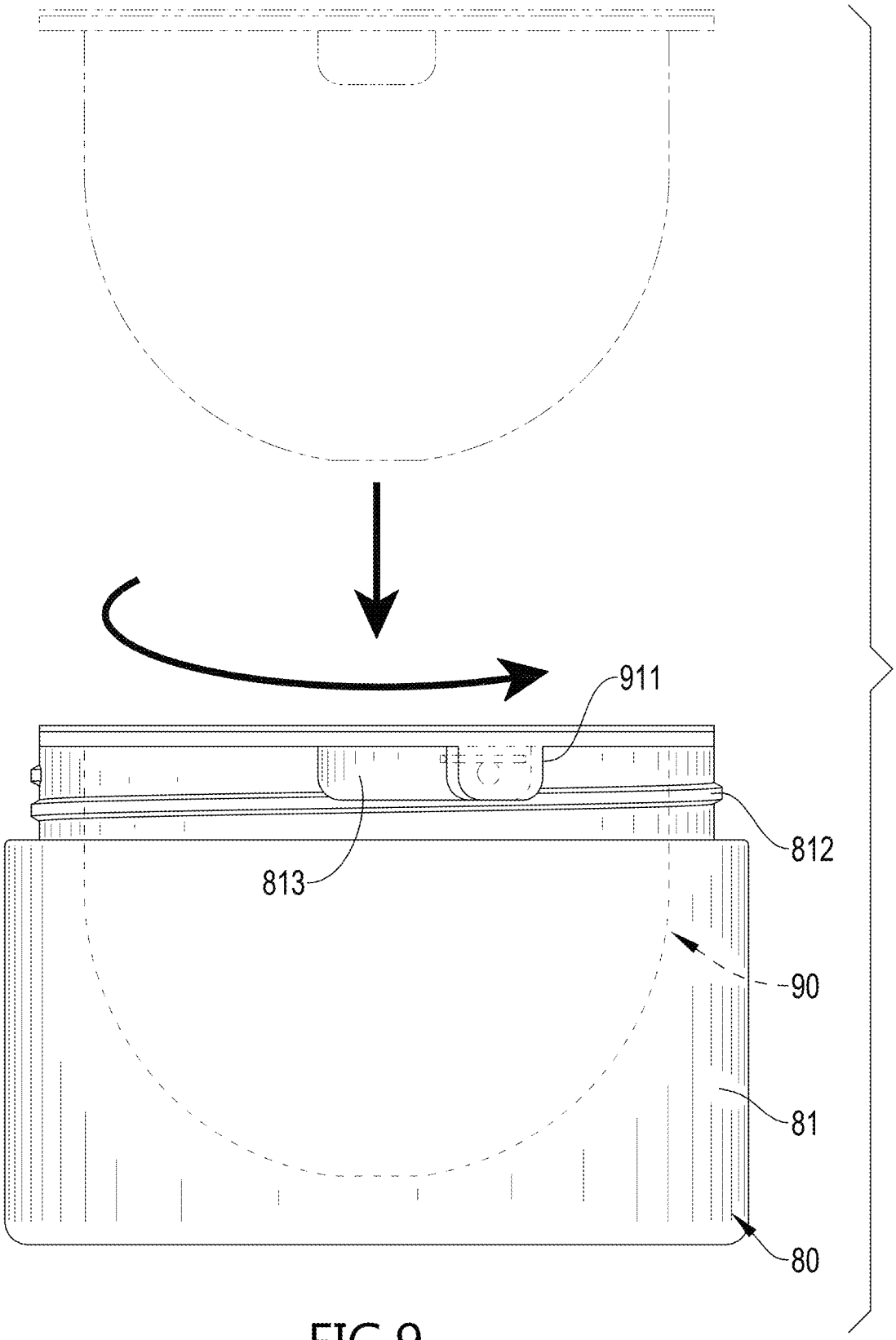
FIG.9 PRIOR ART
FIG. 9 is an operational side view of the conventional cosmetic container in FIG. 8.

With reference to FIGS. 6 and 7, when the engaging blocks 14 of the outer receptacle 10 are moved to engage with the locking sections 232 of the engaging recesses 23, the positioning parts 25 of the refill receptacle 20 and the blocking parts 15 of the outer receptacle 10 engage with one another respectively to fix the refill receptacle 20 in position. Whereby, the refill receptacle 20 may not easily slip off or be rotated relative to the outer receptacle 10 and cannot be separated from the outer receptacle 10. The consumer can easily make sure that the refill receptacle 20 is already fastened to the outer receptacle 10 in position while assembling.

To replace the refill receptacle 20 with a new one, the consumer may grip the holding portions 22 of the refill receptacle 20 to rotate the refill receptacle 20 relative to the outer receptacle 10, to move the multiple engaging blocks 14 to separate from the guiding sections 231, respectively. After that, the consumer may remove the refill receptacle 20 from the outer receptacle 10.

With reference to FIGS. 1 and 2, since the engaging blocks 14 on the internal peripheral surface of the rim 13 of the outer receptacle 10 respectively engage with the engaging recesses 23 of the refill receptacle 20, the engagement features with uneven surfaces are kept from an external surface of the outer receptacle 10. Whereby, cosmetic residues and dirt and grease are prevented from being stuck on the outer receptacle 10, and hygiene and safety of the cosmetics within the cosmetic container is improved. Since the engaging blocks 14 of the outer receptacle 10 are formed on the internal peripheral surface of the rim 13, when the refill receptacle 20 is disposed in the outer receptacle 10, the engaging blocks 14 and the engaging recesses 23 on the external peripheral surface of the refill receptacle 20 are hidden. The appearance of the outer receptacle 10 is improved by hiding the engaging blocks 14 and the engaging recesses 23.

With reference to FIGS. 1 and 2, when the refill receptacle 20 is disposed in the outer receptacle 10, the holding portions 22 of the refill receptacle 20 cover the external peripheral surface of the rim 13. When the consumer intends to replace the refill receptacle 20, he/she can grip the holding portions 22 to remove the refill receptacle 20 for a replacement. Therefore, the consumer can easily apply force to the cosmetic container, thereby improving operational convenience.

With reference to FIGS. 1 to 5, the structural strength of the refill receptacle 20 is enhanced with the holding portions 22 thereof. Deformation of the refill receptacle 20 is reduced when the refill receptacle 20 is subjected to gripping forces. Effect on the assembly of the refill receptacle 20 and the outer receptacle 10 is reduced accordingly. In addition, the multiple engaging recesses 23 and the holding portions 22 are misaligned. During assembling, the positions of the engaging recesses 23 of the refill receptacle 20 relative to the engaging blocks 14 of the outer receptacle 10 can be clearly visualized without blocking the consumer's hand. The assembly operation is more intuitive.

In summary, with the engagement of the engaging blocks 14 at an inner side of the outer receptacle 10 and the engaging recesses 23 of the refill receptacle 20, the refill receptacle 20 is replaceable to reduce resource waste. The appearance of the cosmetic container is improved, and cosmetic residues and dirt and grease are free from being stuck on the cosmetic container of the present invention.

What is claimed is:

1. A cosmetic container, comprising:

an outer receptacle comprising a mounting chamber in the outer receptacle and comprising an upper opening;

a threaded portion formed around the upper opening of the mounting chamber;

a rim extending upwardly from the threaded portion; and multiple engaging blocks protruding from an internal peripheral surface of the rim and spaced apart from one another;

a refill receptacle detachably disposed in the mounting chamber of the outer receptacle and comprising a containing chamber in the refill receptacle and comprising an upper opening;

multiple holding portions arranged around the upper opening of the containing chamber, mounted to the rim of the outer receptacle, and partially covering an external peripheral surface of the rim; and multiple engaging recesses formed in an external peripheral surface of the refill receptacle, spaced apart from one another, and configured to respectively receive and engage with the multiple engaging blocks of the outer receptacle;

a seal detachably disposed on the refill receptacle and configured to close the containing chamber; and an outer cap detachably disposed at the outer receptacle, connected to the threaded portion of the outer receptacle via a thread engagement, and configured to close the mounting chamber, wherein each of the engaging recesses of the refill receptacle has a guiding section and a locking section formed at a side of the guiding section; and each of the engaging blocks of the outer receptacle is configured to be moved into and engage with the locking section via the guiding section of a respective one of the engaging recesses.

2. The cosmetic container as claimed in claim 1, wherein the refill receptacle comprises a blocking flange extending outwardly from the upper opening of the containing chamber and abutting on a top of the rim of the outer receptacle;

the multiple engaging recesses extend downwardly from a bottom of the blocking flange;

the refill receptacle comprises multiple positioning parts formed at the bottom of the blocking flange of the refill receptacle; and the outer receptacle comprises multiple blocking parts formed at the top of the rim of the outer receptacle and configured to be engaged with the multiple positioning parts of the refill receptacle.

3. The cosmetic container as claimed in claim 2, wherein the multiple engaging recesses are arranged between the multiple holding portions.

4. The cosmetic container as claimed in claim 3, wherein the seal has a tab.

5. The cosmetic container as claimed in claim 2, wherein the seal has a tab.

6. The cosmetic container as claimed in claim 1, wherein the multiple engaging recesses are arranged between the multiple holding portions.

7. The cosmetic container as claimed in claim 6, wherein the seal has a tab.

8. The cosmetic container as claimed in claim 1, wherein the seal has a tab.

9. A cosmetic container, comprising:

an outer receptacle comprising a mounting chamber in the outer receptacle and comprising an upper opening;

a threaded portion formed around the upper opening of the mounting chamber;

a rim extending upwardly from the threaded portion; and multiple engaging blocks protruding from an internal peripheral surface of the rim and spaced apart from one another;

a refill receptacle detachably disposed in the mounting chamber of the outer receptacle and comprising a containing chamber in the refill receptacle and comprising an upper opening;

multiple holding portions arranged around the upper opening of the containing chamber, mounted to the rim of the outer receptacle, and partially covering an external peripheral surface of the rim; and multiple engaging recesses formed in an external peripheral surface of the refill receptacle, spaced apart from one another, and configured to respectively receive and engage with the multiple engaging blocks of the outer receptacle;

a seal detachably disposed on the refill receptacle and configured to close the containing chamber; and an outer cap detachably disposed at the outer receptacle, connected to the threaded portion of the outer receptacle via a thread engagement, and configured to close the mounting chamber, wherein the refill receptacle comprises a blocking flange extending outwardly from the upper opening of the containing chamber and abutting a top of the rim of the outer receptacle;

the multiple engaging recesses extend downwardly from a bottom of the blocking flange;

the refill receptacle comprises multiple positioning parts formed at the bottom of the blocking flange of the refill receptacle; and the outer receptacle comprises multiple blocking parts formed at the top of the rim of the outer receptacle and configured to be engaged with the multiple positioning parts of the refill receptacle.

10. The cosmetic container as claimed in claim 9, wherein the multiple engaging recesses are arranged between the multiple holding portions.

11. The cosmetic container as claimed in claim 10, wherein the seal has a tab.

12. The cosmetic container as claimed in claim 9, wherein the seal has a tab.

* * * * *